US009416952B2

(12) United States Patent
Chinniah et al.

(10) Patent No.: US 9,416,952 B2
(45) Date of Patent: Aug. 16, 2016

(54) LIGHTING APPARATUS WITH A LIGHT SOURCE COMPRISING LIGHT EMITTING DIODES

(71) Applicant: GE Lighting Solutions LLC, East Cleveland, OH (US)

(72) Inventors: Jeyachandrabose Chinniah, Pontiac, MI (US); Ashfaqul Islam Chowdhury, Broadview Heighs, OH (US); Gary Robert Allen, Chesterland, OH (US); Jeremias Anthony Martins, Twinsburg, OH (US); Anthony Rotella, Cleveland Heights, OH (US)

(73) Assignee: GE LIGHTING SOLUTIONS LLC, East Cleveland, OH (US)

( * ) Notice: Subject to any disclaimer, the term of this patent is extended or adjusted under 35 U.S.C. 154(b) by 29 days.

(21) Appl. No.: 14/079,992

(22) Filed: Nov. 14, 2013

(65) Prior Publication Data

US 2014/0070690 A1 Mar. 13, 2014

Related U.S. Application Data

(63) Continuation of application No. 13/189,052, filed on Jul. 22, 2011, now Pat. No. 8,608,347.

(51) Int. Cl.

| | |
|---|---|
| ***F21V 1/00*** | (2006.01) |
| ***F21V 29/00*** | (2015.01) |
| ***F21K 99/00*** | (2016.01) |

(Continued)

(52) U.S. Cl.

CPC ..... *F21V 29/20* (2013.01); *F21K 9/135* (2013.01); *F21K 9/50* (2013.01); *F21V 7/04* (2013.01); *F21V 7/041* (2013.01); *F21V 29/773* (2015.01); *F21V 3/02* (2013.01); *F21Y 2101/02* (2013.01)

(58) Field of Classification Search

CPC ..... F21K 9/135; F21V 29/20; F21V 29/773; F21Y 2101/02

USPC ..... 362/294, 311.02, 311.04, 311.05, 241

See application file for complete search history.

(56) References Cited

U.S. PATENT DOCUMENTS

| | | | |
|---|---|---|---|
| 6,932,496 | B2 | 8/2005 | Rizkin et al. |
| 7,396,146 | B2 | 7/2008 | Wang |

(Continued)

FOREIGN PATENT DOCUMENTS

| | | |
|---|---|---|
| EP | 2236917 A1 | 10/2010 |

OTHER PUBLICATIONS

EcoSmart 13-Watt (60W) LED A19 Lamp Warm White Light Bulb, Jul. 13, 2011, http://www.homedepot.com/Electrical-Light-Bulbs-LED/EcoSmart/h_d1/N-bm79Z4b8Z5.

*Primary Examiner* — Ali Alavi

(74) *Attorney, Agent, or Firm* — GE Global Patent Operation; Peter T. DiMauro

(57) ABSTRACT

Embodiments of a lighting apparatus with a light source using one or more light emitting diodes (LEDs) to generate light. In one embodiment, the lighting apparatus comprises a light diffusing assembly that generates an optical intensity profile consistent with incandescent lamps. The light diffusing assembly comprises an envelope and a reflector element having frusto-conical member and an aperture element disposed therein. The lighting apparatus can also comprise a heat dissipating assembly with a plurality of heat dissipating elements disposed radially about the envelope. In one example, the heat dissipating elements are spaced apart from the envelope to promote convective heat dissipation.

15 Claims, 9 Drawing Sheets

(51) Int. Cl.

| | |
|---|---|
| ***F21V 7/04*** | (2006.01) |
| ***F21V 29/77*** | (2015.01) |
| *F21V 3/02* | (2006.01) |
| *F21Y 101/02* | (2006.01) |

(56) References Cited

U.S. PATENT DOCUMENTS

| | | | | |
|---|---|---|---|---|
| 8,882,284 | B2 * | 11/2014 | Tong et al. | 362/84 |
| 2005/0007772 | A1 | 1/2005 | Yen | |
| 2005/0174780 | A1 | 8/2005 | Park | |
| 2006/0092640 | A1 | 5/2006 | Li | |
| 2007/0297178 | A1 | 12/2007 | Tain et al. | |
| 2011/0018417 | A1 | 1/2011 | Lai et al. | |
| 2011/0128742 | A9 | 6/2011 | Yuen et al. | |
| 2011/0242816 | A1 * | 10/2011 | Chowdhury et al. | 362/294 |
| 2011/0242817 | A1 * | 10/2011 | Chowdhury et al. | 362/294 |
| 2013/0058098 | A1 * | 3/2013 | Kim et al. | 362/294 |
| 2013/0194796 | A1 * | 8/2013 | Progl | 362/235 |
| 2013/0214666 | A1 | 8/2013 | Leung et al. | |

* cited by examiner

LIGHTING APPARATUS WITH A LIGHT SOURCE COMPRISING LIGHT EMITTING DIODES

This application is a continuation of commonly-owned application Ser. No. 13/189,052, filed on 22 Jul. 2011 (now allowed), which is hereby incorporated by reference in its entirety.

BACKGROUND

The subject matter of the present disclosure relates to lighting and lighting devices and, more particularly, to embodiments of a lighting apparatus using light-emitting diodes (LEDs), wherein the embodiments exhibit an optical intensity distribution consistent with common incandescent lamps.

Incandescent lamps (e.g., integral incandescent lamps and halogen lamps) mate with a lamp socket via a threaded base connector (sometimes referred to as an "Edison base" in the context of an incandescent light bulb), a bayonet-type base connector (i.e., bayonet base in the case of an incandescent light bulb), or other standard base connector. These lamps are often in the form of a unitary package, which includes components to operate from standard electrical power (e.g., 110 V and/or 220 V AC and/or 12 VDC). In the case of incandescent and halogen lamps, these components are minimal, as the lamp comprises an incandescent filament that operates at high temperature and efficiently radiates excess heat into the ambient. Many incandescent lamps are omni-directional light sources. These types of lamps provide light of substantially uniform optical intensity distribution (or, "optical intensity"). Such lamps find diverse applications such as in desk lamps, table lamps, decorative lamps, chandeliers, ceiling fixtures, and other applications where a uniform distribution of light in all directions is desired.

Solid-state lighting technologies such as LEDs and LED-based devices often have performance that is superior to incandescent lamps. This performance can be quantified by its useful lifetime (e.g., its lumen maintenance and its reliability over time). For example, whereas the lifetime of incandescent lamps is typically in the range about 1000 to 5000 hours, lighting devices that use LED-based devices are capable of operation in excess of 25,000 hours, and perhaps as much as 100,000 hours or more.

Unfortunately, LED-based devices are highly directional by nature. Common LED devices are flat and emit light from only one side. Thus, although superior in performance, the optical intensity of many commercially-available LED lamps intended as incandescent replacements is not consistent with the optical intensity of incandescent lamps.

Yet another challenge with solid-state technology is the need to adequately dissipate heat. LED-based devices are highly temperature-sensitive in both performance and reliability as compared with incandescent or halogen filaments. These features are often addressed by placing a heat sink in contact with or in thermal contact with the LED device. However, the heat sink may block light that the LED device emits and hence further limits the ability to generate light of uniform optical intensity. Physical constraints such as regulatory limits that define maximum dimensions for all lamp components, including light sources, further limit that ability to properly dissipate heat.

BRIEF SUMMARY OF THE INVENTION

The present disclosure describes embodiments of a lighting apparatus with an optical intensity consistent with an incandescent lamp and with adequate heat dissipation to avoid problems with excess heat. Other features and advantages of the disclosure will become apparent by reference to the following description taken in connection with the accompanying drawings.

BRIEF DESCRIPTION OF THE DRAWINGS

Reference is now made briefly to the accompanying drawings, in which.

Where applicable like reference characters designate identical or corresponding components and units throughout the several views, which are not to scale unless otherwise indicated.

DETAILED DESCRIPTION OF THE INVENTION

As used herein, an element or function recited in the singular and proceeded with the word "a" or "an" should be understood as not excluding plural said elements or functions, unless such exclusion is explicitly recited. Furthermore, references to "one embodiment" of the claimed invention should not be interpreted as excluding the existence of additional embodiments that also incorporate the recited features.

Figure 1:
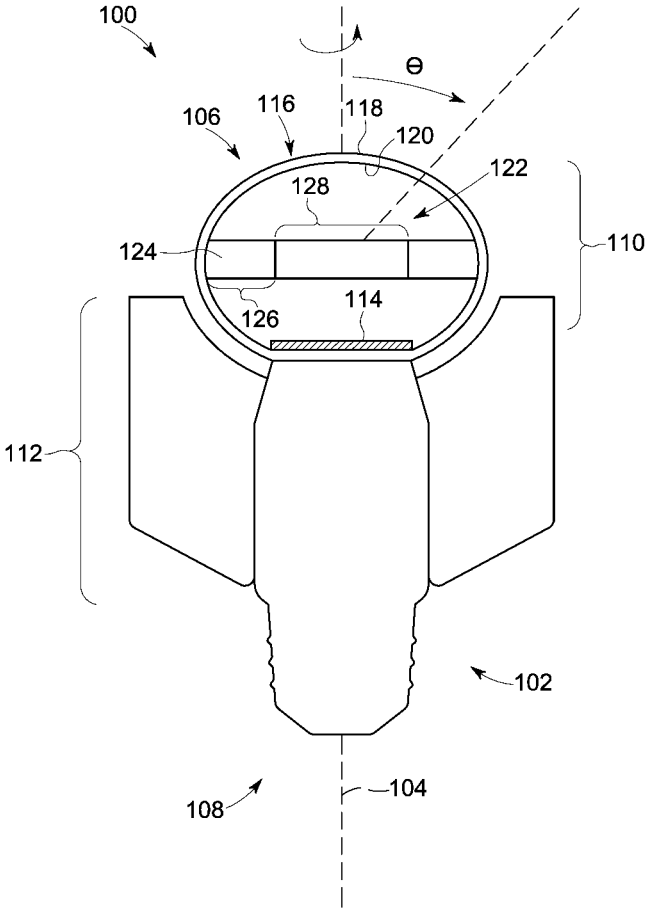
FIG. 1 depicts a schematic diagram of a side view of one exemplary embodiment of a lighting apparatus.

FIG. 1 illustrates an exemplary embodiment of a lighting apparatus 100. The lighting apparatus 100 comprises a base 102, a center axis 104, a north pole 106, and a south pole 108. The north pole 106 and the south pole 108 form a coordinate system that is useful to describe the spatial distribution of illumination that the lighting apparatus generates. The coordinate system is typically of the spherical coordinate system type, which in the present example comprises an elevation or latitude coordinate $\theta$ and an azimuth or longitude coordinate $\phi$. For purposes of the discussion below, the latitude coordinate $\theta=0°$ at the north pole 106 and the latitude coordinate $\phi=180°$ at the south pole 108.

The lighting apparatus 100 also comprises a light diffusing assembly 110, a heat dissipating assembly 112, and a light source 114 which generates light. The light diffusing assembly 110 has an envelope 116, which in one example comprises light-transmissive material. The envelope 116 has an outer surface 118, an inner surface 120, and an interior volume 122. Inside of the interior volume 122, the light diffusing assembly 110 comprises a reflector element 124 with an outer reflective portion 126 and an inner transmissive portion 128.

At a relatively high level, embodiments of the lighting apparatus 100 generate light with a relative optical intensity distribution (or "optical intensity") at a level of about 100±20% over values of the latitude coordinate θ of about 0° to about 135° or greater. In one embodiment, the lighting apparatus 100 maintains a relative optical intensity at a level of about 100±20% at values of the latitude coordinate θ of about 0° to about 150° or greater. In another embodiment, the lighting apparatus 100 maintains a relative optical intensity at a level of about 100±10% at values of the latitude coordinate θ of about 0 to about 150° or greater. These characteristics comply with target values for optical intensity that the Department of Energy defines for solid-state lighting products as well as other industry standards and ratings (e.g., Energy Star). For example, levels of optical intensity that the lighting apparatus 100 provides are suitable to replace common, incandescent light bulbs. Moreover, physical characteristics of the lighting apparatus 100 are consistent with the physical lamp profile of such incandescent light bulbs, where the outer dimension defines boundaries in which the lighting apparatus 100 must fit. Examples of this outer dimension meets one or more regulatory limits (e.g., ANSI, NEMA, etc.).

The envelope 116 can be substantially hollow and have a curvilinear geometry, e.g., spherical, spheroidal, ellipsoidal, toroidal, ovoidal, etc, that diffuses light. In some embodiments, the envelope 116 comprises a glass element, although this disclosure contemplates a variety of light-transmissive material such as diffusive plastics (e.g., diffusing polycarbonate) and/or diffusing polymers that diffuse light. Materials of the envelope 116 may be inherently light-diffusive (e.g., opal glass) or can be made light-diffusive in various ways such as by frosting and/or other texturing of the inside surface (e.g., the inner surface 120) and/or the outer surface (e.g., the outer surface 118) to promote light diffusion. In one example, the envelope 116 comprises a coating (not shown) such as enamel paint and/or other light-diffusive coating (available, for example, from General Electric Company, New York, USA). Suitable types of coatings are found on glass bulbs of some incandescent or fluorescent light bulbs. In still other examples, manufacturing techniques may embed light-scattering particles or fibers or other light scattering media in the material of the envelope 116.

The reflector element 124 fits within the envelope 116 in a position to intercept light from the light source 114. Fasteners such as adhesive can secure the peripheral edge of the reflector element 124 to the inner surface 120. In some embodiments, the inner surface 120 and the reflector element 124 can comprise one or more complimentary features (e.g., a boss and/or a ledge), the combination of which secure the reflector element 124 in position. These features may form a snap-fit or have another mating configuration that prevents the reflector element 124 from moving.

The inner transmissive portion 128 is proximate the center axis 104. Materials for the inner transmissive portion 128 may be a light diffuser comprising glass, plastic, ceramic, or surface diffusers and like materials that promote the scattering and transmission of light therethrough. Materials for the inner transmissive portion 128 may also be a light transmitter having minimal or no scattering, comprising glass, plastic, ceramic, or other optically transparent material. The inner transmissive portion 128 may also be an open aperture allowing light to transmit through without modification. The inner transmissive portion 128 may also be omitted.

In the present example, the outer reflective portion 126 bounds the inner transmissive portion 128 and has optical properties that reflect or transmit or scatter light or combination of reflection, transmission, and scattering of light. These optical properties may result from materials used to construct the reflector element 124 including the inner transmissive portion 128. In some examples, the outer reflective potion 126 comprises an optically opaque and highly reflective material such as a solid polymer, ceramic, glass, or metal, or a reflective coating, or laminate on a substrate, etc. The reflected light may be specularly reflected, or diffusely reflected, or a combination of specularly and diffusely reflected. In one example, both sides of the reflector element 124 comprise a coating/laminate to form the outer reflective portion 126. In some other examples, the outer reflective portion 126 comprises an optically reflective and transmissive material such as a solid polymer, ceramic, glass, or a reflective coating or laminate on a substrate, etc., that can reflect a portion of light and transmit a portion of light. The transmitted portion of light may be scattered or partially scattered or not scattered. The reflected portion of light may be specularly reflected, or diffusely reflected, or a combination of specularly and diffusely reflected. In still other examples, in lieu of distinctly arranged transmissive and reflective portions (e.g., the outer reflective portion 126 and the inner transmissive portion 128), the reflector element 124 can have a pattern of one or more reflective elements and/or transmissive elements that cause the reflector element 124 to both transmit and reflect light.

Figure 2:
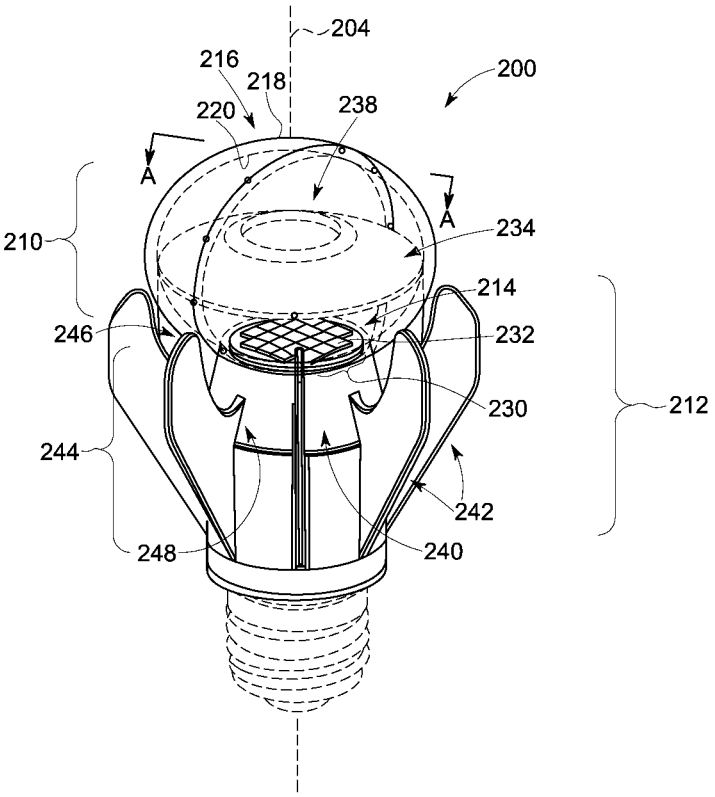
FIG. 2 depicts a perspective view of another exemplary embodiment of a lighting apparatus.
Figure 3:
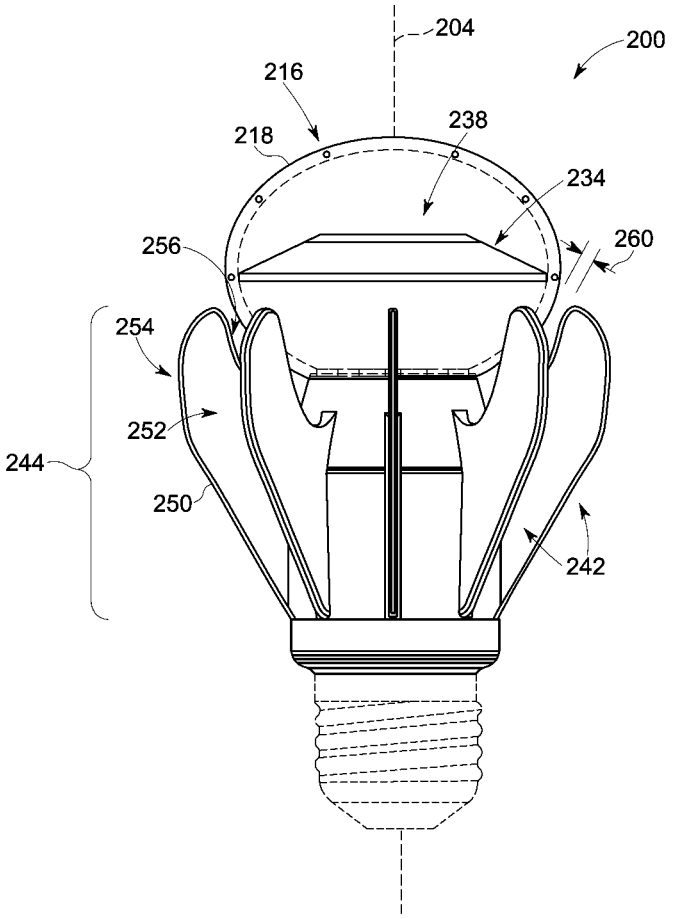
FIG. 3 depicts a side view of the lighting apparatus of FIG. 2.
Figure 4:
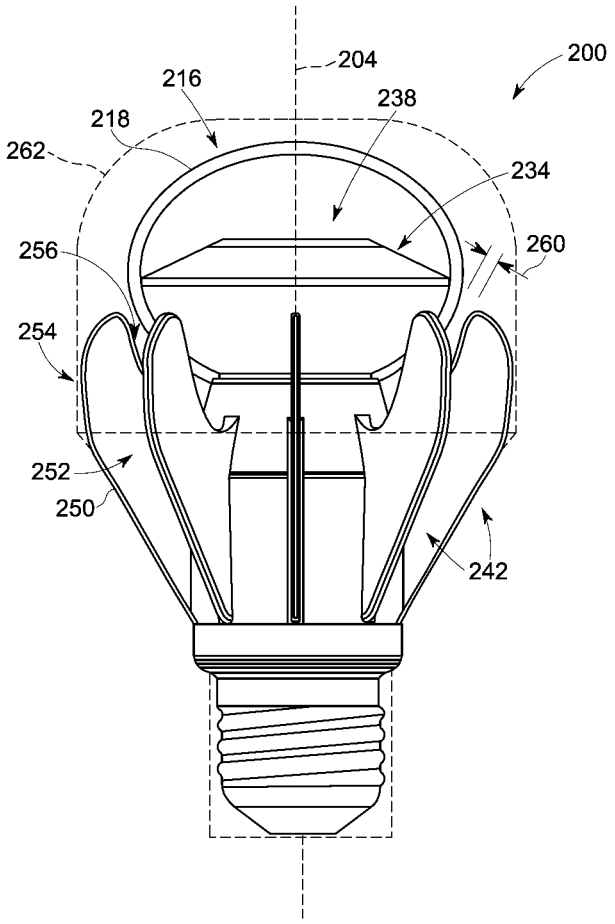
FIG. 4 depicts a side view of the lighting apparatus of FIG. 2 compared to an example of an industry standard lamp profile.
Figure 5:
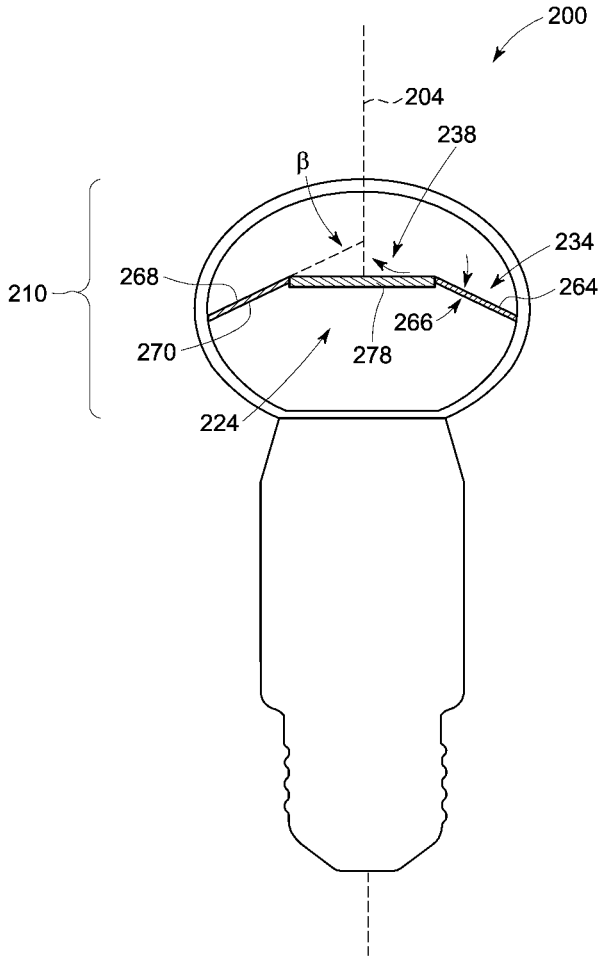
FIG. 5 depicts a cross-section, side view of the lighting apparatus taken along line A-A of FIG. 2.
Figure 6:
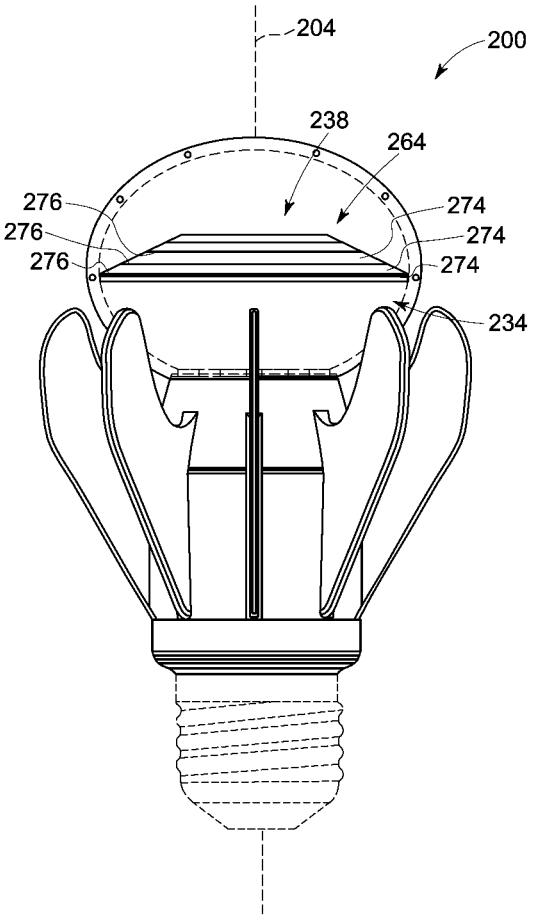
FIG. 6 depicts a side view of the lighting apparatus of FIG. 2.
Figure 7:
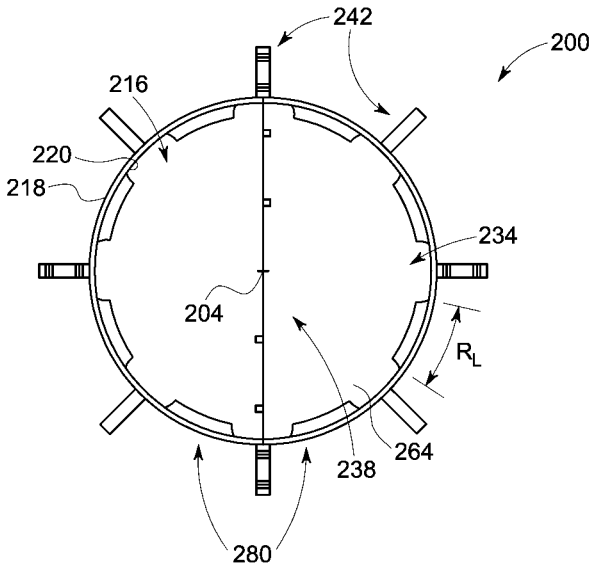
FIG. 7 depicts a top view of the lighting apparatus of FIG. 2.

Turning next to FIGS. 2, 3, 4, 5, 6, and 7 another exemplary embodiment of a lighting apparatus 200 is shown. FIG. 2 depicts a perspective view of the lighting apparatus 200 and FIGS. 3, 4 and 6 illustrate a side view of the lighting apparatus 200. FIG. 5 illustrates a cross-section of the lighting apparatus 200 taken along line A-A (FIG. 2). FIG. 7 illustrates a top view of the lighting apparatus 200. Like numerals are used to identify like components as between FIG. 1 and FIGS. 2, 3, 4, 5, 6 and 7, except that the numerals are increased by 100 (e.g., 100 in FIG. 1 is now 200 in FIGS. 2,3, 4, 5, 6, and 7). For example, embodiments of the lighting apparatus 200 comprise a center axis 204, a light diffusing assembly 210, a heat dissipating assembly 212, and a light source 214. The light diffusing assembly 210 comprises an envelope 216 with an outer surface 218 and an inner surface 220.

In FIG. 2, the light source 214 comprises a solid-state device 230 with one or more light-emitting elements 232, e.g., light-emitting diodes (LEDs). The reflector element 224 comprises a cone element 234 and an aperture element 238. The heat dissipating assembly 212 comprises a base element 240, in thermal contact with the light source 214, and one or more heat dissipating elements 242 coupled to the base element 240. The heat dissipating elements 242 promote conduction, convection, and radiation of heat away from the light source 214. For example, the heat dissipating elements 242 have an element body 244 with a tip end 246 and a base end 248 that can conduct thermal energy from the base element 240.

The solid-state device 230 can comprise a planar LED-based light source that emits light into a hemisphere having a nearly Lambertian intensity distribution, compatible with the light diffusing assembly 210 for producing omni-directional illumination distribution. In one embodiment, the planar LED-based Lambertian light source includes a plurality of LED devices (e.g., LEDs 232) mounted on a circuit board (not shown), which is optionally a metal core printed circuit board (MCPCB). The LED devices may comprise different types of LEDs. For example, the solid-state device 230 may comprise one or more first LED devices and one or more second LED devices having respective spectra and intensities that mix to render white light of a desired color temperature and color rendering index (CRI). In one embodiment, the first LED devices output white light, which in one example has a greenish rendition (achievable, for example, by using a blue- or violet-emitting LED chip that is coated with a suitable "white" phosphor). The second LED devices output red and/or orange light (achievable, for example, using a GaAsP or AlGaInP or other epitaxy LED chip that naturally emits red and/or orange light). The light from the first LED devices and second LED devices blend together to produce improved color rendition. In another embodiment, the planar LED-based Lambertian light source can also comprise a single LED device or an array of LED emitters incorporated into a single LED device, which may be a white LED device and/or a saturated color LED device and/or so forth. In another embodiment, the LED emitter are organic LEDs comprising, in one example, organic compounds that emit light.

As best shown in FIG. 3, the element body 244 of the heat dissipating elements 242 has a peripheral edge 250 that forms the outer periphery or shape of the heat dissipating elements 242. Each of the heat dissipating elements 242 have an element surface 252 on the front and back of the element body 244. The peripheral edge 250 comprises an outer peripheral edge 254 and an inner peripheral edge 256 proximate the outer surface 218 of the envelope 216. A gap 260 separates the inner peripheral edge 256 from the outer surface 218 of the envelope 216.

The gap 260 spaces the tip end 246 of the heat dissipating elements 242 away from the outer surface 218 of the envelope 216. Generally the gap 260 is smaller at tip end 246 than at the base end 248. Surprisingly, this configuration improves heat dissipation and reduces the LED board temperature by about 5° C. at least as compared to other designs in which all or a portion of the heat dissipating element 242 nearly contacts the envelope 216. It is believed that the gap 260 provides space between the inner peripheral edge 256 and the outer surface 218 to facilitate air flow and convection currents. The space effectively reduces friction and drag on the air, which improves air flow over the outer surface 218 of the envelope 216, the front and back faces of the element body 244, and the inner peripheral edge 256. The improved flow of air increases the rate of convection and the rate of heat dissipation. In one embodiment, the gap 260 at the tip end 246 is from about 1.75 mm to about 3 mm, about 2 mm or greater and, in one example, the gap 260 is about 3 mm or more. In one embodiment the gap 260 at the base end 248 is greater than the gap 260 at the tip end 246, where the gap 260 can be from about 3 mm to about 10 mm or more.

In addition to the lighting apparatus 200, FIG. 4 shows that the outer peripheral edge 254 fits within a lamp profile 262, the extent of which is defined by an outer dimension D, which can be from about 60 mm (e.g., typical of a GE A19 incandescent lamp) to about 69.5 mm (e.g., the maximum diameter allowed by ANSI for an A19 lamp. Embodiments of the lighting apparatus 200 are amenable to many other examples of the lamp profile 262. Some examples include A-type (e.g., A15, A19, A21, A23, etc.) and G-type (e.g., G20, G30, etc.) as well as other profiles that various industry standards known and recognized in the art define.

In designing the heat dissipating assembly 212, the limiting thermal impedance in a passively cooled thermal circuit is typically the convective impedance to ambient air (that is, dissipation of heat into the ambient air). It is generally simpler to optimize the thermal conduction through the bulk of the heat dissipating assembly 212 than it is to optimize the convention and radiation to ambient from the heat dissipating assembly 212. Furthermore, the convective heat transfer to ambient from the heat dissipating assembly 212 is generally much greater than the radiative heat transfer to ambient from the heat dissipating assembly 212. So, to achieve the most effective cooling of the LEDs, it is required to minimize the thermal impedance of the convective heat transfer to ambient from the heat dissipating assembly 212.

This convective impedance is generally proportional to the surface area of the heat dissipating assembly 212. In the case of a replacement lamp application, where the lighting apparatus 200 must fit into the same space as the traditional Edison-type incandescent lamp being replaced (e.g., into the lamp profile 262), there is a fixed limit on the available amount of surface area of the imaginary outside element profile. Therefore, it is advantageous to increase the available surface area that is in contact with ambient air as much as possible for heat dissipation into the ambient, such as by placing the heat dissipating elements 242 or other heat dissipating structures around or adjacent to the light source 214, and by maximizing the surface area of each of the heat dissipating elements 242, and by maximizing the number of heat dissipating elements 242, while maintaining a minimal blockage of light from the envelope 116. Functionally, however, the configuration of the heat dissipating elements 242 may be required to vary to meet not only the physical lamp profile (e.g., the lamp profile 262) of current regulatory limits (ANSI, NEMA, etc.), but also to satisfy consumer aesthetics or manufacturing constraints as well.

Thermal properties of the heat dissipating elements 242 can have a significant effect on the total energy that the heat dissipating assembly 212 dissipates and, accordingly, the temperature of the solid-state device 230 and any corresponding driver electronics. Since the performance and reliability of the solid-state device 230 and driver electronics is generally limited by operating temperature, it is critical to select one or more materials with appropriate properties. The thermal conductivity of a material defines the ability of a material to conduct heat. Since the solid-state device 230 may have a very high heat density, the heat dissipating assembly 212 should preferably comprise materials with high thermal conductivity so that the generated heat can be conducted through a low thermal resistance away from the solid-state device 230.

In general, metallic materials have a high thermal conductivity, with common structural metals such as alloy steel, cast aluminum, extruded aluminum, copper, or engineered composite materials such as thermally-conductive polymers. Exemplary materials can exhibit thermal conductivities of about 50 W/m-K, from about 80 W/m-K to about 100 W/m-K, 170 W/m-K, 390 W/m-K, and from about 1 W/m-K to about 30 W/m-K, respectively. A high conductivity material will allow more heat to move from the thermal load to ambient and result in a reduction in temperature rise of the thermal load. The heat dissipating assembly 212 (e.g., the base element 240 and the heat dissipating elements 242) can comprise one or more high thermal conductivity materials including metals (e.g., aluminum), plastics, plastic composites, ceramics, ceramic composite materials, nano-materials, such as carbon nanotubes (CNT) or CNT composites.

Practical considerations, such as manufacturing process or cost, may affect the selection of materials and the effective thermal properties. For example, cast aluminum, which is generally less expensive in large quantities, has a thermal conductivity value approximately half of extruded aluminum. It is preferred for ease and cost of manufacture to use predominantly one material for the majority of the heat dissipating assembly 212 (e.g., the base element 240 and the heat dissipating elements 242), but combinations of cast/extrusion methods of the same material or even incorporating two or more different materials into construction of the heat dissipating assembly 212 to maximize cooling are also possible.

Embodiments of the lighting apparatus 200 can comprise 3 or more heat dissipating elements 242 arranged radially about the center axis 204. The heat dissipating elements 242 can be equally spaced from one another so that adjacent ones of the heat dissipating elements 242 are separated by at least about 45° for an 8-fin apparatus and 22.5° for an 18-fin apparatus measured along the longitude coordinate (p. Physical dimensions (e.g., width, thickness, and height) can also determine the necessary separation between the heat dissipating elements 242 as well as other physical aspects of the lighting apparatus 200.

Moreover, the physical dimensions, placement, and configuration of the heat dissipating elements 242 may also impact a variety of lighting characteristics, including the optical intensity of the lighting apparatus 200. For example, the width of the heat dissipating elements 242 affects primarily the latitudinal uniformity of the light distribution, the thickness of the heat dissipating elements 242 affects primarily the longitudinal uniformity of the light distribution, and the height of the heat dissipating elements 242 affects how much of the latitudinal uniformity is disturbed. In general terms, in order to minimize the distortion of the light intensity distribution the same fraction of the emitted light should interact with the heat dissipating elements 242 at all angles θ. In functional terms, to maintain the existing light intensity distribution of the light diffusing assembly 210, the area of the element surfaces 252 in view of the light source 214 created by the width and thickness of the heat dissipating elements 242 should stay in a constant ratio with the surface area of the emitting light surface that they encompass.

The heat dissipating assembly 212 can also have optical properties that affect the resultant optical intensity. When light impinges on a surface, it can be absorbed, transmitted, or reflected. In the case of most engineering thermal materials, they are opaque to visible light, and hence, visible light can be absorbed or reflected from the surface. In consideration of optical properties, selection and design of the light apparatus 200 should contemplate the optical reflectivity efficiency, optical specularity, and the size and location of the heat dissipating elements 242. As discussed hereinbelow, concerns of optical efficiency, optical reflectivity, and intensity will refer herein to the efficiency and reflectivity the wavelength range of visible light, typically about 400 nm to about 700 nm.

The absolute reflectivity of the surface of the heat dissipating elements 242 will affect the total efficiency of the lighting apparatus 200 as well as the intrinsic light intensity distribution of the light source 214. Though only a small fraction of the light emitted from the light source 214 may impinge the heat dissipating assembly 212 with heat dissipating elements 242 arranged around the light source 214, if the reflectivity is very low, a large amount of flux will be lost on the element surfaces 252 of the heat dissipating elements 242, and reduce the overall efficiency of the lighting apparatus 200.

The optical intensity is affected by both the redirection of emitted light from the light source 214 and also absorption of flux by the heat dissipating assembly 212. In one embodiment, if the reflectivity of the heat dissipating elements 242 is kept at a high level, such as greater than 70%, the distortions in the optical intensity can be minimized. Similarly, the longitudinal and latitudinal intensity distributions can be affected by the surface finish of the thermal heat sink and surface enhancing elements. Smooth surfaces with a high specularity (mirror-like) distort the underlying intensity distribution less than diffuse (Lambertian) surfaces as the light is directed outward along the incident angle rather than perpendicular to the surface of the heat dissipating elements 242.

The thermal emissivity, or efficiency of radiation in the far infrared region (approximately 5-15 μm) of the electromagnetic radiation spectrum, is also an important property for the surfaces of the heat dissipating elements 242. Generally, very shiny metal surfaces have very low emissivity, on the order of 0.0-0.2. Hence, some sort of coating or surface finish may be desirable, such as paints (0.7-0.95) or anodized coatings (0.55-0.85). A high emissivity coating on the heat dissipating elements 242 may dissipate approximately 40% more heat than bare metal with low emissivity. Selection of a high-emissivity coating must also take into account the optical properties of the coating, as low reflectivity or low specularity in the visible wavelength can adversely affect the overall efficiency and light distribution of the lighting apparatus 100.

A range of surface finishes, varying from a specular (reflective) to a diffuse (Lambertian) surface can be selected for the heat dissipating elements 242. The specular designs can be a reflective base material or an applied highly specular coating. The diffuse surface can be a finish on the heat dissipating elements 242, or an applied paint or powder coating or foam or fiber mat or other diffuse coating. Each provides certain advantages and disadvantages. For example, a highly reflective surface may have the ability to maintain the light intensity distribution, but may be thermally disadvantageous due to the generally lower emissivity of bare metal surfaces. Or a highly diffuse, high-reflectivity coating may require a thickness that provides a thermally insulating barrier between the heat dissipating elements 242 and the ambient air.

In addition, highly specular surfaces may be difficult to maintain over the life of the lighting apparatus 200, which is typically 25,000-50,000 hours. A visibility transparent coating may be applied over the specular surface to improve the resistance to abrasion and oxidation of the surface. Further if the visibly transparent coating has a high emittance in the infrared, then the thermal radiation may be desirably enhanced. In one embodiment, the heat diffusing elements 242 can comprise a diffuse surface. The maintenance of the diffuse surface might be robust over the life of the lighting apparatus than a specular surface, and can also provide a visual appearance that is similar to existing incandescent omnidirectional light sources. A diffuse finish might also have an increased thermal emissivity compared to a specular surface which will increase the heat dissipation capacity of the heat sink, as described above. In one example, the coating will possess a highly specula surface and also a high emissivity, examples of which would be highly specular paints, or high emissivity coatings over a highly specular finish or coating.

The cross-section of FIG. 5 and the top view of FIG. 6 shows one configuration of the reflector element 224. In FIG. 5, the cone element 234 has a frusto-conical member 264 with a thin-wall profile 266, an upper surface 268, and a lower surface 270. The frusto-conical member 264 forms an angle β with the center axis 204. In one embodiment, the angle β may be less than 90°, in which case the frusto-conical member 264 has its larger diameter at the bottom and its smaller diameter at the top, as shown in FIG. 5. In one embodiment, the angle β may be 90°, in which case the frusto-conical member 264 simplifies to a flat circle and, in construction, the flat circuit comprises an aperture at the center. In another embodiment, the angle β may be greater than 90°, so that the frusto-conical member 264 is inverted. In yet another embodiment, the frusto-conical member 264 might be a combination of multiple frusto-conical members, one or more of which has different angle β and joined together, e.g., at their edges. An example of this multiple-member construction is shown in FIG. 6, wherein the frusto-conical member 264 comprises a plurality of members 274 with edges 276 abutting adjacent members.

Referring back to FIG. 5, the aperture element 238 comprises a circular member 278 that is aligned with the center axis 204. The specific dimensions of each optical element (e.g., the frusto-conical member 264, the circular member 278, the lighting assembly 210, etc.) to be used for any target relative optical distribution will depend on a combination (1) LED light source (or "engine") size and native optical distribution determined by standard source imaging goniometers, and (2) optical properties (e.g., scattering, transmittance, reflectance, absorption, etc.) of the envelop, cone element and surface, annular surface, and coatings on the heating dissipating element. In one example, where a low loss surface diffuser is used in the annulus the circular member 278 can have a diameter of about 10 mm to about 20 mm or greater, as measured about the center axis 204. In other examples, the diameter can range from about 1 mm to about 60 mm. Other shapes (other than circular) are also possible for the aperture element 238 including square, rectangular, polygonal, annular, etc. In another embodiment, the circular member 278 may be three-dimensional with a surface geometry such as a frusto-conical, conical, hemispherical, and the like.

The thin-wall profile 266 can have thickness from about 0.5 mm to about 3 mm or more and/or, for example, of suitable thickness to provide the relative optical intensity as described above. In one embodiment, one or more of the upper surface 268 and the lower surface 270 can have a coating disposed thereon. Values for the angle β can be from about 45° to about 135°, and in one example from about 55° to about 75° and, in another example the angle β is 65° or greater.

In FIG. 7, the frusto-conical member 264 comprises a plurality of slots 280 found between the peripheral edge of the frusto-conical member 264 and the inner surface 220 of the envelope 216. In one embodiment, the frusto-conical member 264 includes the slots 280 to provide the lighting apparatus 200 with a more appealing and/or aesthetically pleasing appearance by allowing light to illuminate the envelope 216 near the edge of the frusto-conical member 264 to reduce the bright-dark contrast that otherwise is visible at the edge. The slots 274 can be spaced radially about the center axis 204. Each of the slots 274 can have a radial length ($R_L$), which can vary as desired. For example, the radial length ($R_L$) can vary from slot-to-slot, or the slots 274 can be configured so the radial length ($R_L$) is uniform among the plurality of slots 274. In one embodiment, the slots 274 comprise about 2% (slot width/cone diameter) and/or about 10% of the total area of the frusto-conical member 264.

The slots 280 may be in any other geometric shape or size of opening so as to provide a region within the frusto-conical member 264 where light is transmitted through to the envelope 216. This feature can enhance the light intensity distribution near the north pole (e.g., the north pole 106 (FIG. 1)) or to provide a more uniformly lit appearance on the surface of the envelope 216. For example, the slots 280 might be circles, ellipses, polygons, or any other shape. The slots 280 may be positioned at or near the edge of the frusto-conical member 264 or at or near the circular member 272, or anywhere in between. The slots 280 may be voids of air, or may be filled with any of the materials that are available for use in the circular member 272 which allow transmission of light.

The following example further illustrates various aspects and embodiments of the present invention.

EXAMPLE

In one embodiment, a lighting apparatus (e.g., the lighting apparatus 100, 200 of FIGS. 1, 2, 3, 4, 5, 6, and 7) comprises the following:

An example of an envelope (e.g., the envelope 116, 216 of FIGS. 1, 2, 3, 4, and 5) comprising a Teijin ML5206 low loss diffuser having a spheriodal shape with dimensions of 53 mm×53 mm×39 mm.

An example of a reflector element (e.g., the reflector element 124, 224 of FIGS. 1, 2, 3, 4, 5, 6, and 7). The reflector element comprises a cone element (e.g., the cone element 234 of FIGS. 4, 5, 6, and 7) comprising a slotted polycarbonate cone with high-reflectance paint and/or high-reflectance self-adhesive laminates and/or integral molded high-reflectance white plastics. The reflector element also comprises an aperture element (e.g., the aperture element 238 of FIGS. 3, 4, 5, 6, and 7) comprising an 80° surface diffuser center aperture, wherein 80° is the full-width at half-maximum (FWHM) of the intensity distribution of light scattered by the diffuser.

An example of a light source (e.g., the light source 114, 214 of FIGS. 1 and 2) comprises a circular LED package on board assembly.

An example of a heat dissipating assembly (e.g., the heat dissipating assembly 112, 212 of FIGS. 1 and 2) comprises eight (8) heat dissipating elements (e.g., the heat dissipating elements 242 of FIGS. 2, 3, and 4) comprising Al 6061, wherein each of the heat dissipating elements comprises a high reflectance outdoor coating and/or high-reflectance powder coating.

Figure 8:
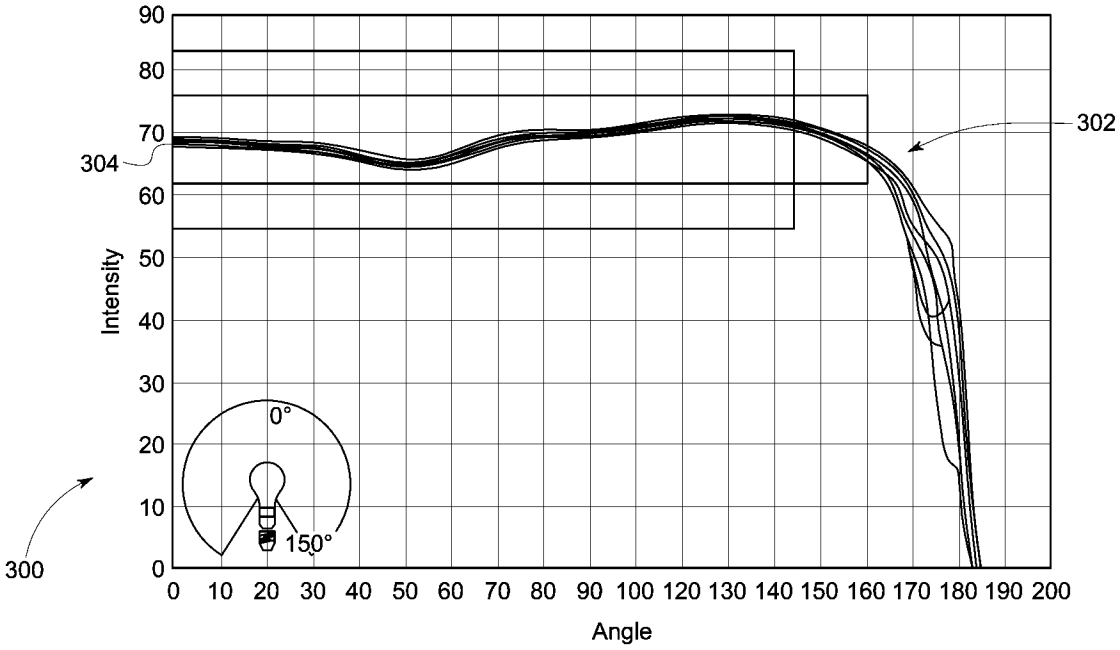
FIG. 8 depicts a plot of an optical intensity distribution profile for an embodiment of a lighting apparatus such as the lighting apparatus of FIGS. 1, 2, 3, 4, 5, 6, and 7.

FIG. 8 illustrates a plot 300 of an optical intensity distribution profile 302 (or "optical intensity" profile 302). Data for the plot 300 was gathered using a Mirror Goniometer from the embodiment of the lighting apparatus having features described above. As the optical intensity profile 302 illustrates, the lighting apparatus achieves a mean optical intensity 304 of about 100±10% at an angle (e.g., the latitude coordinate θ of FIG. 1) up to at least 150°.

Figure 9:
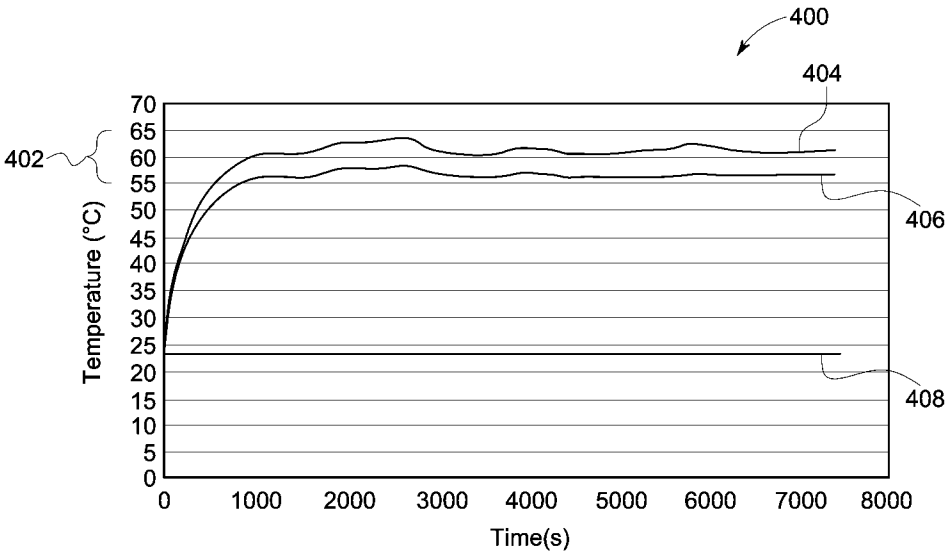
FIG. 9 depicts a plot of LED board temperature profiles for two embodiments of a lighting apparatus such as the lighting apparatus of FIGS. 1, 2, 3, 4, 5, 6, and 7.

FIG. 9 illustrates a plot 400 of thermal profiles 402 comprising an 8-fin profile 404 and a 12-fin profile 406. The thermal profiles 402 also comprise an ambient profile 408. Data for the plot 400 was gathered using a thermocouple secured to one of the heat dissipating elements on the embodiment of the lighting apparatus having features described above. As the 8-fin profile 404 illustrates, the lighting apparatus achieves a mean temperature of 62° C. when measured in a 25° C. ambient.

Table 1 below summarizes data for color uniformity for the embodiment of the lighting apparatus having features described above. The data was gathered using a Mirror Goniometer.

TABLE 1

| | Du'v' | | | |
|---|---|---|---|---|
| θ | 0 | 90 | 180 | 270 |
| 0 | 0.0016 | 0.0018 | 0.0018 | 0.0019 |
| 10 | 0.0020 | 0.0020 | 0.0019 | 0.0019 |
| 20 | 0.0017 | 0.0019 | 0.0017 | 0.0016 |
| 30 | 0.0016 | 0.0019 | 0.0016 | 0.0012 |
| 40 | 0.0013 | 0.0017 | 0.0016 | 0.0011 |
| 50 | 0.0010 | 0.0013 | 0.0019 | 0.0009 |
| 60 | 0.0010 | 0.0009 | 0.0023 | 0.0015 |
| 70 | 0.0014 | 0.0014 | 0.0024 | 0.0020 |
| 80 | 0.0018 | 0.0024 | 0.0025 | 0.0021 |
| 90 | 0.0017 | 0.0026 | 0.0018 | 0.0014 |
| 100 | 0.0018 | 0.0027 | 0.0014 | 0.0011 |
| 110 | 0.0016 | 0.0024 | 0.0011 | 0.0011 |
| 120 | 0.0015 | 0.0020 | 0.0008 | 0.0010 |
| 130 | 0.0013 | 0.0017 | 0.0006 | 0.0005 |
| 140 | 0.0012 | 0.0018 | 0.0004 | 0.0003 |
| 150 | 0.0009 | 0.0016 | 0.0004 | 0.0005 |

Note the color uniformity that the data of Table 1 illustrates.

A sample of embodiments of a lighting apparatus is provided below in which:

In embodiment A, a lighting apparatus, comprising a light diffusing assembly comprising an envelope and a reflector element; and a light source comprising a solid-state device, wherein the light diffusing assembly can disperse light from the solid-state device with an optical intensity distribution of 100±20% over a latitude coordinate θ of 135° or better.

The lighting apparatus of embodiment A, further comprising a plurality of heat dissipating elements disposed radial about the envelope.

The lighting apparatus of embodiment A, wherein the envelope comprises a spheroid shape.

The lighting apparatus of embodiment A, wherein the reflector element comprises an outer reflective portion and an inner transmissive portion.

In embodiment B, a lamp, comprising an envelope from which light can be emitted; and a plurality of heat dissipating elements disposed radially about the envelop, the heat dissipating elements having a tip end spaced apart from the envelope to form an air gap, wherein light from the envelope exhibits an optical intensity of 100±20% over a latitude coordinate θ of 135° or better.

The lamp of embodiment B, wherein the air gap is at least 3 mm.

The lamp of embodiment B, wherein the heat dissipating elements fit within a form factor defined by ANSI standard for A19 lamps.

The lamp of embodiment B, wherein the heat dissipating elements are equally-spaced radially apart from one another.

The lamp of embodiment B, wherein the heat dissipating elements comprise a reflective coating.

The lamp of embodiment B, further comprising a light source in thermal contact with the heat dissipating elements, wherein the light source comprises a plurality of light emitting diodes.

This written description uses examples to disclose embodiments of the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A lighting apparatus, comprising:

an envelope forming an interior volume and comprising light-transmissive material;

a heat dissipating assembly comprising a plurality of heat dissipating elements arranged radially about a center axis;

a reflector element disposed in the interior volume, wherein the reflector element comprises an aperture element disposed at the center axis; and a light source in thermal contact with the heat dissipating assembly.

2. The lighting apparatus of claim 1, wherein the light source comprises one or more light emitting diodes.

3. The lighting apparatus of claim 1, wherein the light source comprises one or more organic light emitting diodes.

4. The lighting apparatus of claim 1, wherein heat dissipating elements have a tip end proximate the envelope, and wherein the air gap at the tip end is about 2 mm or greater.

5. The lighting apparatus of claim 1, wherein the heat dissipating elements fit within an A-type lamp profile or a G-type lamp profile.

6. The lighting apparatus of claim 1, wherein the plurality of heat dissipating elements are spaced-apart from the envelope forming an air gap.

7. The lighting apparatus of claim 1, wherein the plurality of heat dissipating elements are substantially equally spaced from one another.

8. A lighting apparatus, comprising:

an envelope forming an interior volume and comprising light-transmissive material;

a heat dissipating assembly comprising a plurality of heat dissipating elements arranged radially about a center axis;

a reflector element disposed in the interior volume, wherein the reflector element comprises an aperture element disposed at the center axis; and a light source in thermal contact with the heat dissipating assembly;

wherein the plurality of heat dissipating elements have a base end below the envelope and a body element that extends from the base end, the body element terminating at a tip end proximate the envelope.

9. A lighting apparatus, comprising:

an envelope forming an interior volume and comprising light-transmissive material;

a reflector element disposed in the interior volume, wherein the reflector element comprises an aperture element disposed at a center axis of the lighting apparatus; and a light source comprising one or more light emitting diodes.

10. The lighting apparatus of claim 9, wherein the reflector element comprises a frusto-conical member.

11. The lighting apparatus of claim 10, wherein the frusto-conical member tapers from its center axis toward the envelope.

12. The lighting apparatus of claim 9, wherein the reflector element comprises one or more slots disposed radially about the center axis and positioned between the reflector element and the envelope.

13. The lighting apparatus of claim 9, wherein the aperture element comprises a circular member aligned with the center axis.

14. The lighting apparatus of claim 9, wherein said lighting apparatus exhibits an optical intensity distribution of about 100±20% over a latitude coordinate θ of about 135° or greater.

15. The lighting apparatus of claim 9, wherein said lighting apparatus exhibits an optical intensity distribution of about 100±10% over a latitude coordinate of about 150° or greater.

* * * * *